US009261119B2

(12) United States Patent
Hof

(10) Patent No.: US 9,261,119 B2
(45) Date of Patent: Feb. 16, 2016

(54) ELIMINATING TURBULENCE IN WALL BOUNDED FLOWS

(75) Inventor: Björn Hof, Klosterneuburg (DE)

(73) Assignee: INSTITUTE OF SCIENCE AND TECHNOLOGY AUSTRIA, Klosterneuburg (AT)

( * ) Notice: Subject to any disclaimer, the term of this patent is extended or adjusted under 35 U.S.C. 154(b) by 359 days.

(21) Appl. No.: 13/988,841

(22) PCT Filed: Nov. 22, 2011

(86) PCT No.: PCT/EP2011/070680

§ 371 (c)(1), (2), (4) Date: Jul. 15, 2013

(87) PCT Pub. No.: WO2012/069472

PCT Pub. Date: May 31, 2012

(65) Prior Publication Data

US 2013/0284272 A1 Oct. 31, 2013

(30) Foreign Application Priority Data

Nov. 22, 2010 (WO) ..... PCT/EP2010/067959

(51) Int. Cl.

| | |
|---|---|
| ***F15D 1/06*** | (2006.01) |
| ***F17D 1/20*** | (2006.01) |
| *F15D 1/00* | (2006.01) |

(52) U.S. Cl.
CPC .. *F15D 1/06* (2013.01); *F17D 1/20* (2013.01); *F15D 1/007* (2013.01); *Y10T 137/0318* (2015.04); *Y10T 137/8593* (2015.04)

(58) Field of Classification Search
CPC ..... F15D 1/06; F15D 1/007; F15D 1/12; F17D 1/20; Y10T 137/0318; Y10T 137/8593
USPC ..... 137/803, 825; 138/114, 44, 98
See application file for complete search history.

(56) References Cited

FOREIGN PATENT DOCUMENTS

| | | |
|---|---|---|
| CN | 1361406 A | 7/2002 |
| DE | 723718 | 8/1942 |
| GB | 2223821 | 4/1990 |
| WO | 2007/012267 | 2/2007 |

OTHER PUBLICATIONS

Hof, Björn et al.: "Eliminating turbulence in spatially intermittent flows." Science 19, Mar. 2010, vol. 327, No. 5972, pp. 1491-1494.
Notification of Transmittal of International Search Report and Written Opinion, dated Feb. 20, 2012.
Chinese Office Action in co-pending, related Chinese Patent Application No. 201180061350.3 mailed Mar. 13, 2014.

*Primary Examiner* — Craig Schneider
*Assistant Examiner* — Nicole Wentlandt
(74) *Attorney, Agent, or Firm* — Thomas | Horstemeyer, LLP

(57) ABSTRACT

For eliminating turbulence in a wall bounded flow a section of the flow-bounding wall is moved in the direction of the flow over the flow-bounding wall.

29 Claims, 3 Drawing Sheets

ELIMINATING TURBULENCE IN WALL BOUNDED FLOWS

CROSS-REFERENCE TO RELATED APPLICATION

This application is the 35 U.S.C. §371 national stage of PCT Application No. PCT/EP2011/070680, entitled "Eliminating Turbulence in Wall Bounded Flows" and filed Nov. 22, 2011, which is herein incorporated by reference in its entirety and which also claims priority to, and the benefit of, PCT Application No. PCT/EP2010/067959, filed Nov. 22, 2010, which is herein incorporated by reference in its entirety.

FIELD OF THE INVENTION

The present invention generally relates to a method of and an apparatus for eliminating turbulence in a wall bounded flow.

In a wall bounded flow, i.e. in a flow of a fluid over a wall, the wall exerts shear forces onto the fluid, and, as a result, a boundary layer of the flow is formed at the flow-bounding wall in which the flow is affected by the wall.

In such a boundary layer, depending on the actual conditions, the flow may be laminar or turbulent, the drag in a boundary layer being much higher with a turbulent flow than with a laminar flow. Thus, a laminar flow often has big advantages over a turbulent flow in that it saves energy, like for example in pumping a liquid through a pipe or channel.

BACKGROUND OF THE INVENTION

In Björn Hof et al.: Eliminating turbulence in spatially intermittent flows, Science 19, March 2010: Vol. 327, No. 5972, pp. 1491-1494, which in its entirety is incorporated herein by reference, the inventor of the present invention and co-authors disclosed a method of eliminating turbulence in a spatially intermittent flow through a pipe in that the parabolic velocity profile of a laminar flow is distorted to a plug like velocity profile upstream of a turbulent puff. The distortion of the velocity profile reduces the sudden change of the axial velocity across the rear of the turbulent puff. In numerical simulations, this proposal is reported to be successful in eliminating turbulence. Once having eliminated the turbulent puff, a forcing needed to distort the parabolic velocity profile may even be switched off, and the flow continues to re-laminarize. However, Hof et al. point out, that a distortion of the velocity profile at the turbulent laminar interface cannot be as readily implemented in practice as in simulations. Thus, they proposed to use a second turbulent puff upstream of the original one to distort the velocity profile at the rear end of the original puff. When the second turbulent puff is induced at a short distance upstream of the original puff, the short distance between the two puffs is insufficient to allow a parabolic velocity profile to fully develop, despite the fact that the flow is not turbulent between the two puffs. Hof et al. could show that introducing the additional puff allows for keeping the flow in a pipe laminar downstream of the additional puff, even in the area of the original puff. However, they pointed out that their simple strategy only works well for sufficiently small Reynolds-numbers of Re<2000 in pipes, Re<1400 in channels and Re<1800 in ducts, and that it becomes less efficient as Re increases, and once the regime of spatially expanding turbulence is reached (Re>2500 in pipes) it fails. On the other hand, in their numerical simulations, the basic concept of distorting the velocity profile to re-laminarize a turbulence proved successful even with larger Reynolds-numbers and reduced the drag more than by a factor of two.

There still remains a need of having a practicable method of and an apparatus for eliminating turbulence in wall bounded flows which also work at larger Reynolds-numbers.

SUMMARY OF THE INVENTION

In an aspect, the present invention relates to a method of eliminating turbulence in a wall bounded flow, the method comprising the step of moving a section of the flow-bounding wall in the direction of the flow over the flow-bounding wall.

In another aspect, the present invention relates to an apparatus for eliminating turbulence in a wall bounded flow, the apparatus comprising a drive unit moving a section of the flow-bounding wall in the direction of the flow over the flow-bounding wall.

Other features and advantages of the present invention will become apparent to one with skill in the art upon examination of the following drawings and the detailed description. It is intended that all such additional features and advantages be included herein within the scope of the present invention, as defined by the claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION

Figure 1:
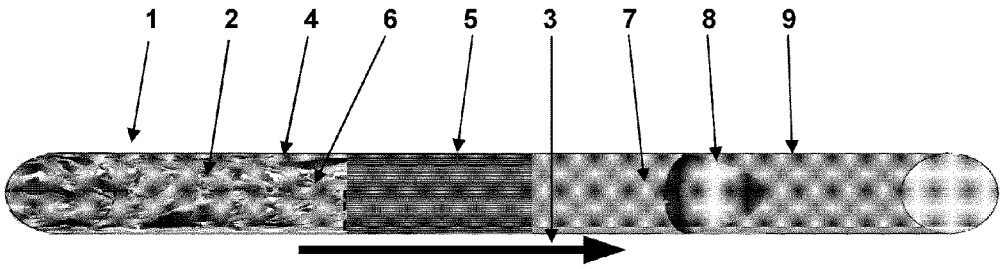
FIG. 1 illustrates the general concept of the new method.

The Reynolds-number as used here is defined as $Re=\bar{U}D/\nu$, where $\bar{U}$ is the mean flow speed or average flow velocity, D is the pipe diameter and $\nu$ is the kinematic viscosity (so far as a flow through a pipe is concerned; otherwise a corresponding definition of Re for a flow through a channel or over a flow-bounding wall is to be applied).

In the new method, a part or section of the flow-bounding wall is moved in the direction of the flow over the flow-bounding wall. In the area of this moved section of the flow-bounding wall, the fluid in the boundary layer of the flow which is located close to the flow-bounding wall is accelerated as compared to its velocity of zero with a fixed flow-bounding wall. With a constant average velocity of the flow, this results in a distortion of the velocity profile in that the maximum difference in velocity between the fluid in the boundary layer directly adjacent to the flow-bounding wall and the fluid in the centre of the flow or even outside the boundary layer is reduced. As a direct consequence, the shearing forces in the boundary layer feeding turbulence are reduced. In fact, the new method is not only able to avoid the occurrence of turbulence but also to re-laminarize an already turbulent flow. If the flow is not disturbed again downstream of the point at which the new method is executed, it may stay laminar indefinitely (Reynolds-number permitting). Thus, a local application of the new method may reduce the drag of a flow over a very long distance, like for example an entire pipe or channel. In this way, the new method may be used to strongly decrease the energy spent for pumping fluids like gases and liquids.

In the new method the moved section of the flow-bounding wall preferably essentially includes the full flow-bounding wall bounding the flow over a length of the flow. I. e., over this length of the flow there are preferably no parts of the flow-bounding wall which are not moved in the direction of the flow.

The suitable length of the flow over which the moved section should include the full flow-bounding wall will depend on the velocity at which the section of the flow-bounding wall is moved. Generally, this length of the flow should be at least about 20, preferably at least about 25 and more preferably at least about 30 boundary layer thicknesses long. In this context the boundary thickness layer may be defined as the thickness over which the flow-bounding wall affects the flow. If the flow-bounding wall encloses a lumen through which the flow flows, like in case of a pipe or a channel, the moved section of the flow-bounding wall generally is at least about 20, preferably at least about 25 and more preferably at least about 30 diameters of this lumen long.

At the downstream end of the section of the flow-bounding wall moved in the direction of the flow, care should be taken to not induce any new turbulence in the laminar flow leaving the section. This may be achieved by a smooth transit between the moved section and the adjacent fixed section of the flow-bounding wall. Such a smooth transit may be achieved in that the moved section only includes a part of the flow-bounding wall at its downstream end. Another means of avoiding turbulences at the downstream end of the moved section is to keep a free flow cross section through which the flow flows constant or to slightly increase this free flow cross section to decelerate the flow.

In the new method, other sections of the flow-bounding wall than the moved section are not moving in the direction of the flow but are fixed. Such fixed sections of the flow-bounding wall may be arranged both upstream and downstream of the moved section.

It has already been indicated that the length of the flow over which the section of the flow-bounding wall which is moved in the direction of the flow according to the invention should extend may depend on the velocity at which the section is moved. Generally, this velocity should be at least about 40%, preferably at least about 50% and most preferably at least about 60% of an average flow velocity of the flow over the unmoved flow-bounding wall. However, even with lower velocities of the moved section of the flow-bounding wall than 40% of an average flow velocity of the flow the laminarization effect may be achieved.

On the other hand, the velocity of the moved section of the flow-bounding wall may, in principle, even be higher than the average flow velocity over the unmoved flow-bounding wall. Preferably, however, this velocity is at maximum about the same as the average flow velocity over the unmoved flow-bounding wall which makes implementation of the present invention much easier with very quick flows.

In particular, the moved section of the flow-bounding wall may be a partial cover of the overall flow-bounding wall. For example, it may be a film covering a part of the flow-bounding wall. Such a film can be circulated in a closed loop, a feed back branch of the film loop running outside the area of the flow.

In a particular embodiment of the new method, wherein the flow-bounding wall encloses a lumen through which the flow flows, the moved section of the flow-bounding wall is a liner of a section of this lumen. This liner may be moved in the direction of the flow out of an initial position into an end position, and afterwards be retracted back into its initial position. This retracting may take place at a time at which the flow is not flowing over the flow-bounding wall or it may take place at much lower velocity against the direction of the flow than in the direction of the flow when turbulence in the flow is to be laminarized. This embodiment of the invention is well-suited for such cases in which the turbulence in the flow to be re-laminarized does not permanently occur.

The new method easily works with high Reynolds-numbers above 3000, 4000 or even above 5000.

The new apparatus for eliminating turbulence in a wall bounded flow comprises a drive unit moving a section of the flow-bounding wall in the direction of the flow over the flow-bounding wall. Most of the details of the new apparatus correspond to the details of the new method already described.

The present invention is applicable to flows only bounded by the flow-bounding wall in one direction like a flow over a surface of an aeroplane or submarine. The invention, however, is of particular interest with flows through pipes and channels. Here, the moved section may be a partial liner of the pipe or channel. Particularly, this partial liner may be a film tube or consist of a plurality of film bands lining a part of the pipe or channel.

Now referring in greater details to the drawings, FIG. 1 shows a pipe 1 through which a fluid 2 flows in a flow direction 3. In a part 4 of the pipe 1 located upstream of a control region 5, the fluid 2 displays a turbulent flow 6. In the control region 5 this turbulent flow 6 is laminarized such that a laminar flow 7 leaves the control region 5 and stays laminar with the typical parabolic velocity profile 8 over the cross section of the pipe 1 in a part 9 of the pipe 1 downstream of the control region 5 as long as the laminar flow 7 is not disturbed for turbulence again.

Figure 2:
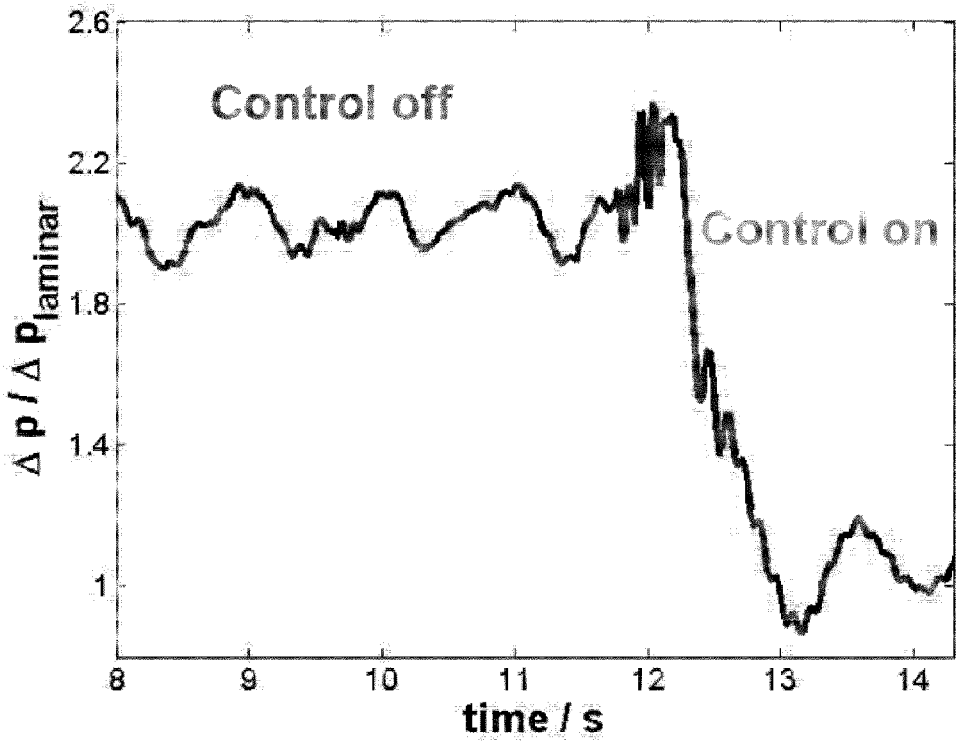
FIG. 2 is a graph of measurement data indicating the effect of the new method.

FIG. 2 is a graph of a pressure difference $\Delta p$ measured over a length of the part 9 of the pipe 1 according to FIG. 1 and normalized to the pressure difference $\Delta p_{laminar}$ of a laminar flow through the part 9. This normalized pressure difference is plotted over the time for a flow of a Reynolds-number Re=3240. At the beginning, the method according to the present invention laminarizing the flow in the control region 5 of FIG. 1 is not yet active ("Control off"). Then the method is started ("Control on"). As a result, the drag of the flow indicated by the normalized pressure difference drops to the drag or pressure difference of a laminar flow. Thus, laminarizing the flow in the control region 5 reduces the drag of the flow through the downstream part 9 of the pipe 1 by more than a factor of two.

Figure 3:
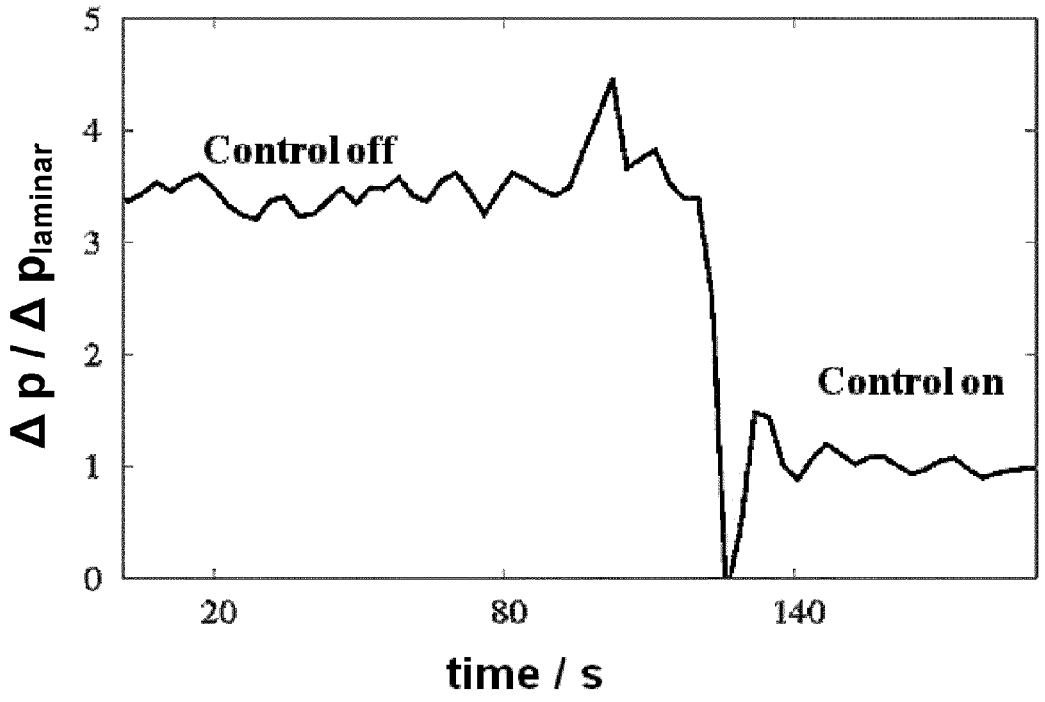
FIG. 3 is a graph of further measurement data obtained at a higher Reynolds-number than FIG. 2 and also indicating the effect of the new method.

FIG. 3 is another graph of a pressure difference $\Delta p$ measured over a length of the part 9 of the pipe 1 according to FIG. 1 and normalized to the pressure difference $\Delta p_{laminar}$ of a laminar flow through the part 9. This normalized pressure difference is plotted over the time for a flow of a Reynolds-number Re=5900. The further details of the measurent and the basic result are the same as in FIG. 2. However, the effect of the present invention at the higher Reynolds-number is even higher: Laminarizing the flow in the control region 5 reduces the drag of the flow through the downstream part 9 of the pipe 1 by a factor of 3.5 here.

Figure 4:
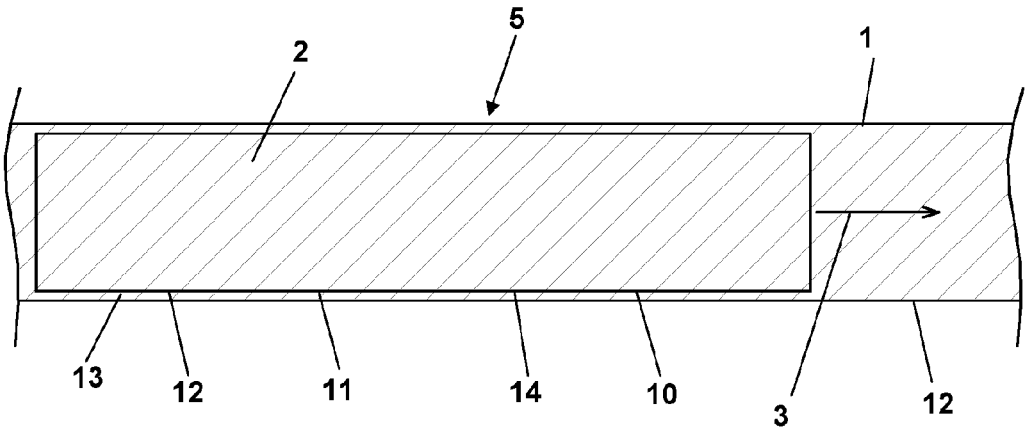
FIG. 4 shows a first embodiment of an apparatus for implementing the control region of FIG. 1.

FIG. 4 shows the particular set up of the control region 5 with which the data according to FIG. 2 and FIG. 3 have been obtained. A pipe section 10 partially lining the pipe 1 is moved along the axis of the pipe 1 in the flow direction 3. The wall 11 of the pipe section 10 fully encloses the fluid 2 within the pipe 1 in radial direction, i.e., the wall 11 is the entire flow-bounding wall 12 in the area of the pipe section 10. Further, the liner 14 defines that section 13 of the flow-bounding wall 12 which is moved in the flow direction 3 through the pipe 1 according to the present invention, and it may also be designated as a liner 14 of the pipe 1. The relative length of the section 13 indicated in FIG. 4 is too short. In the experiment producing the results indicated in FIG. 2 the length of the section 13 was about 60 times the diameter of the pipe 1.

Figure 5:
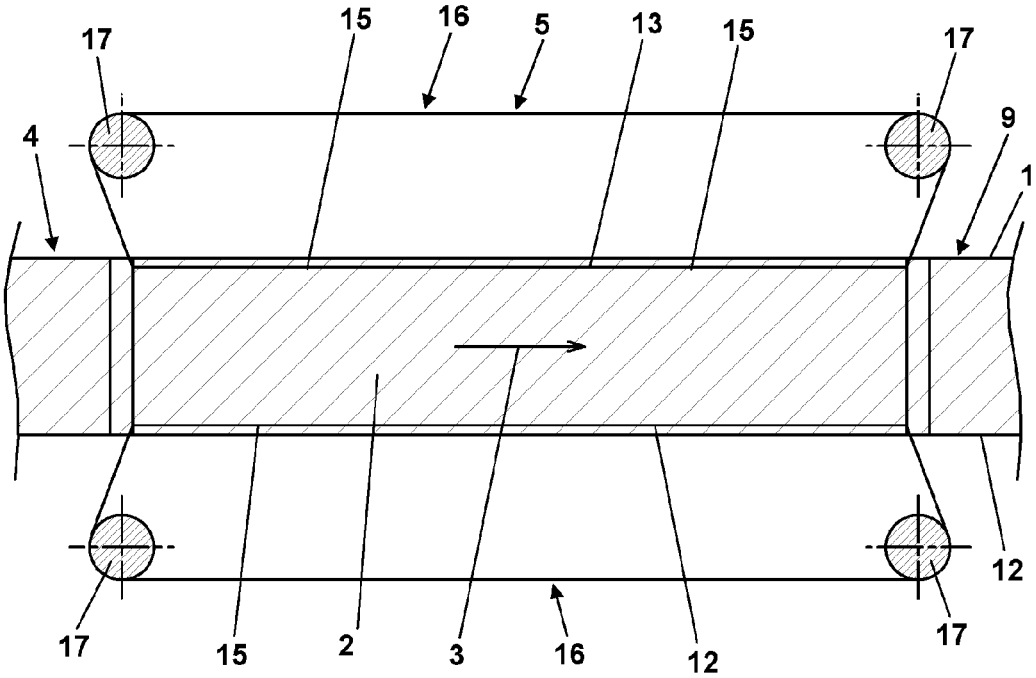
FIG. 5 shows a second embodiment of an apparatus for implementing the control region of FIG. 1.

FIG. 5 shows another embodiment of the control section 5 in the pipe 1. Here, the liner 14 of the pipe 1 is made of film bands 15 running as closed loops 16 around rollers 17 which are located outside the pipe 1. In this embodiment, the moved section 13 of the flow-bounding wall 12 stays in place, i.e., it does not move along the pipe 1, although the parts of the film bands 15 in contact with the fluid 2 move in the flow direction 3.

Many variations and modifications may be made to the preferred embodiments of the invention without departing substantially from the spirit and principles of the invention. All such modifications and variations are intended to be included herein within the scope of the present invention, as defined by the following claims.

LIST OF REFERENCE NUMERALS

1 pipe
2 fluid
3 flow direction
4 part
5 control region
6 turbulent flow
7 laminar flow
8 parabolic velocity profile
9 part
10 pipe section
11 wall
12 flow-bounding wall
13 moved section
14 liner
15 film band
16 closed loop
17 roller

The invention claimed is:

1. A method of eliminating turbulence in a wall bounded flow, the method comprising the step of moving a section of the flow-bounding wall in the direction of the flow over the flow-bounding wall, wherein the flow-bounding wall encloses a lumen through which the flow flows, and wherein the moved section of the flow-bounding wall is a liner of a section of the lumen.

2. The method of claim 1, wherein the moved section essentially includes the full flow-bounding wall bounding the flow over a length of the flow.

3. The method of claim 2, wherein the flow-bounding wall affects the flow over a boundary layer thickness, and wherein the moved section essentially includes the full flow-bounding wall bounding the flow over a length of the flow which is at least about 20 boundary layer thicknesses long.

4. The method of claim 2, wherein the moved section essentially includes the full flow-bounding wall bounding the flow over a length of the flow which is at least about 20 diameters of the lumen long.

5. The method of claim 1, wherein, at its downstream end, the moved section only includes a part of the flow-bounding wall.

6. The method of claim 1, wherein the flow-bounding wall bounds a free flow cross section through which the flow flows, and wherein the free flow cross section is kept constant or increased in downstream direction at the downstream end of the moved section of the flow-bounding wall.

7. The method of claim 1, wherein sections of the flow-bounding wall at least upstream or downstream of the moved section of the flow-bounding wall are not moving in the direction of the flow over the flow-bounding wall.

8. The method of claim 1, wherein the moved section of the flow-bounding wall is moved at a velocity of at least about 40% of an average flow velocity of the flow over the unmoved flow-bounding wall.

9. The method of claim 1, wherein the moved section of the flow-bounding wall is moved at a velocity of at maximum about 100% of an average flow velocity over the unmoved flow-bounding wall.

10. The method of claim 1, wherein the moved section of the flow-bounding wall is a partial cover of the flow-bounding wall.

11. The method of claim 1, wherein the liner is moved in the direction of the flow over the flow-bounding wall out of an initial position at a velocity over a length of the flow, when turbulence is detected, and afterwards retracted at a lower velocity against the direction of the flow back into its initial position.

12. The method of claim 1, wherein the Reynolds-number of the flow is above 3000.

13. An apparatus for eliminating turbulence in a wall bounded flow, the apparatus comprising a drive unit moving a section of the flow-bounding wall in the direction of the flow over the flow-bounding wall, wherein the moved section of the flow-bounding wall is a film covering a part of the flow-bounding wall.

14. The apparatus of claim 13, wherein the moved section essentially includes the full flow-bounding wall bounding the flow over a length of the flow.

15. The apparatus of claim 14, wherein the flow-bounding wall encloses a lumen through which the flow flows, and wherein the moved section essentially includes the full flow-bounding wall bounding the flow over a length of the flow which is at least about 20 diameters of the lumen long.

16. The apparatus of claim 13, wherein, at its downstream end, the moved section only includes a part of the flow-bounding wall.

17. The apparatus of claim 13, wherein the flow-bounding wall bounds a free flow cross section through which the flow flows, and wherein the free flow cross section is kept constant or increased in downstream direction at the downstream end of the moved section of the flow-bounding wall.

18. The apparatus of claim 13, wherein sections of the flow-bounding wall at least upstream or downstream of the moved section of the flow-bounding wall are fixed in the direction of the flow over the flow-bounding wall.

19. The apparatus of claim 13, wherein the moved section of the flow-bounding wall is a partial cover of the flow-bounding wall.

20. The apparatus of claim 13, wherein the drive unit circulates the film in a closed loop, a feed back branch of the film loop running outside the flow.

21. An apparatus for eliminating turbulence in a wall bounded flow, the apparatus comprising a drive unit moving a section of the flow-bounding wall in the direction of the flow over the flow-bounding wall, wherein the flow-bounding wall encloses a lumen through which the flow flows, and wherein the moved section of the flow-bounding wall is a liner of a section of the lumen.

22. The apparatus of claim 21, wherein the moved section of the flow-bounding wall is a partial liner of a pipe or channel having the lumen.

23. The apparatus of claim 22, wherein the moved section of the flow-bounding wall is a film tube or consist of film bands lining a part of the pipe or channel.

24. The apparatus of claim 21, wherein the moved section essentially includes the full flow-bounding wall bounding the flow over a length of the flow.

25. The apparatus of claim 24, wherein the flow-bounding wall encloses a lumen through which the flow flows, and wherein the moved section essentially includes the full flow-bounding wall bounding the flow over a length of the flow which is at least about 20 diameters of the lumen long.

26. The apparatus of claim 21, wherein, at its downstream end, the moved section only includes a part of the flow-bounding wall.

27. The apparatus of claim 21, wherein the flow-bounding wall bounds a free flow cross section through which the flow flows, and wherein the free flow cross section is kept constant or increased in downstream direction at the downstream end of the moved section of the flow-bounding wall.

28. The apparatus of claim 21, wherein sections of the flow-bounding wall at least upstream or downstream of the moved section of the flow-bounding wall are fixed in the direction of the flow over the flow-bounding wall.

29. The apparatus of claim 21, wherein the moved section of the flow-bounding wall is a partial cover of the flow-bounding wall.

* * * * *